US007674066B2

(12) United States Patent
Wehmeyer

(10) Patent No.: US 7,674,066 B2
(45) Date of Patent: Mar. 9, 2010

(54) TACTILE TILE PRODUCT FOR THE VISUALLY IMPAIRED, METHOD OF MANUFACTURE AND METHODS OF CONDUCTING BUSINESS THEREWITH

(76) Inventor: Donald Wehmeyer, 227 Bellevue Way NE., PMB 449, Kirkland, WA (US) 98004

( * ) Notice: Subject to any disclaimer, the term of this patent is extended or adjusted under 35 U.S.C. 154(b) by 0 days.

(21) Appl. No.: 11/258,617

(22) Filed: Oct. 25, 2005

(65) Prior Publication Data

US 2007/0092335 A1 Apr. 26, 2007

(51) Int. Cl.
*E01C 5/18* (2006.01)

(52) U.S. Cl. ..... 404/19; 404/42; 404/43

(58) Field of Classification Search ..... 404/19, 404/12–16, 34–42, 73, 75
See application file for complete search history.

(56) References Cited

U.S. PATENT DOCUMENTS

| | | | | | |
|---|---|---|---|---|---|
| 112,168 | A * | 2/1871 | Neefus | 52/181 |
| 348,782 | A * | 9/1886 | Sawyer | 52/177 |
| 691,434 | A * | 1/1902 | Barnett | 52/177 |
| 791,017 | A * | 5/1905 | Farmer | 52/181 |
| 1,592,591 | A * | 7/1926 | Amele | 264/34 |
| 1,879,207 | A * | 9/1932 | Gupwell | 404/134 |
| 2,663,915 | A * | 12/1953 | Dietrich | 52/155 |
| 3,196,763 | A * | 7/1965 | Rushton | 404/21 |
| 3,624,955 | A * | 12/1971 | Matsubayashi | 446/117 |
| 3,732,020 | A * | 5/1973 | Judge et al. | 404/19 |
| 4,490,069 | A * | 12/1984 | Cushman et al. | 404/15 |
| 4,715,743 | A * | 12/1987 | Schmanski | 404/9 |
| 5,303,669 | A * | 4/1994 | Szekely | 116/205 |
| 5,331,306 | A * | 7/1994 | Carruthers, II | 340/425.5 |
| D365,857 | S * | 1/1996 | Lyman | D21/491 |
| 5,626,094 | A * | 5/1997 | Jeffery et al. | 116/205 |
| D382,353 | S * | 8/1997 | Berger | D25/157 |
| D399,011 | S * | 9/1998 | Berger | D25/163 |
| 2004/0067336 | A1 * | 4/2004 | Munroe, II | 428/131 |

* cited by examiner

*Primary Examiner*—Raymond W Addie
(74) *Attorney, Agent, or Firm*—John P. Luther; Ladas & Parry LLP

(57) ABSTRACT

The present invention provides a tactile tile comprising hemispherical outward protruding domes on an upper surface for pedestrian traffic, and a plurality of longitudinal and transverse members integral with each other and integral with a bottom side of the tile opposite the upper surface forming a honeycomb pattern.

19 Claims, 7 Drawing Sheets

TACTILE TILE PRODUCT FOR THE VISUALLY IMPAIRED, METHOD OF MANUFACTURE AND METHODS OF CONDUCTING BUSINESS THEREWITH

COPYRIGHT NOTICE

Copyright 2005 Donald T. Wehmeyer. All rights reserved. A portion of the disclosure of this patent application/patent document contains material which is subject to copyright protection. The copyright owner has no objection to the facsimile reproduction by anyone of this document or patent which issues therefrom as it appears in the United States Patent and Trademark Office file and records

FIELD OF THE INVENTION

The present invention relates generally to products which aid the visually impaired and their method of manufacture and use, and more particularly to detectable warning surfaces and way-finding solutions for use in pedestrian areas, and further to an array of methods of conducting business comprising such products, methods and uses.

BACKGROUND OF THE INVENTION

Products and methods for producing detectable warnings for the visually impaired on various surfaces, such as pedestrian access areas, have been available for some time. For example, U.S. Pat. No. 5,385,770 describes a product with a repeating pattern of raised protrusions on a surface which has tactile and visual characteristics of detectable warnings which contrast with tactile and visual characteristics of surrounding surfaces.

U.S. Pat. No. 6,890,124 discloses a pre-cast detectable warning tile system for visually handicapped persons and which is intended for placement on walkways, crosswalks and other areas of pedestrian traffic. The tile is made for embedding in fresh concrete on a walking surface, and includes substantially planner top and bottom surfaces with the top surfaces having a plurality of raised elements configured as truncated dome structures and the bottom surfaces being scarified. The tiles can be provided as both angled planar cut pieces and rectangular planar pieces which can be placed or aligned together without being interconnected to form a walking surface which is flush to the edge of a walking surface.

International Patent Application No. PCT/US01/03964 discloses a detectable warning and wayfinding system for the visually impaired or handicapped which comprises a non-slip material, such as silicon carbide, to provide surface texture, and which also contains ridges and elongated truncated domes for detectability in pedestrian locations.

In another example, U.S. Published Patent Application No. 2005/0066623 discloses embedment tile for producing a tactilely detectable surface in concrete or asphalt which comprises a tile member substantially planar in form, and which has a pattern of upwardly extending projections on its upper surface forming a tactilely detectable pattern, such as useful for a warning or wayfinder means or for decoration, etc. The lower surface of each tile member comprises two or more cross-beams with hollow channels and end openings, and optional apertures to enable flow of concrete and air in and around the cross-beams to facilitate rapid installation. There may also be support members which project down further than the cross-beams and which function for support and to interlock the embedment tile to the concrete or asphalt once such material sets and hardens. Further, the sidewalls of the cross-beams may be V-shaped in cross section to facilitate their embedding in wet concrete or asphalt by moving such material into and around the cross-beams for an efficient insertion.

Additional examples include, for instance, a tactile identification and direction guidance system disclosed in U.S. Published Patent Application No. 2003/0037720; embedment tiles for pedestrian platforms and walkways provided in U.S. Pat. No. 5,775,835; a marking system for pedestrian crossings as disclosed in International Patent Application No. PCT/DK93/00272; and transit boarding panels as disclosed in U.S. Pat. Nos. 6,895,622 and 6,449,790.

The problem with many, if not all, of these products designed for embedment in sidewalk, street or other pedestrian walkway material, such as concrete and asphalt, however, is the difficulty in replacing broken tile units which degrade from use or other collisions, such as with snow removal equipment, end-loader buckets and the like. Many of these products have substantial pockets of trapped air formed under their walking surfaces during installation, and which can contribute to fracturing and other breakage during use over time, thereby rendering a once safe and helpful surface dangerous and requiring its replacement. Oftentimes replacement is only accomplished by time consuming and expensive labor intensive fracturing of the embedding concrete or other material, such as with a jackhammer, to remove broken or fractured tiles for their replacement. Due to the importance of such identification and wayfinding materials for handicapped people and their necessary existence and upkeep, more durable products and methods for their installation have long been needed.

SUMMARY OF THE INVENTION

The present invention overcomes the problems of durability and replaceability found in conventional pedestrian identification and wayfinding surfaces by providing textured tile units which can be detachably installed and set into position on or in freshly poured or on hardened concrete or other non-hardened or hardened material, such as asphalt, to be incorporated into a surface to provide visual and tactile warnings to the visually impaired or handicapped, or to other pedestrians in need of warning.

In a preferred aspect of the invention, pre-cast textured tiles are provided for their flush detachable installation in a pedestrian-use surface, which tiles comprise a substantially planer top surface for human contact, with the surface itself comprising a plurality of raised surface elements projecting upward for human contact and sound emitting purposes, preferably arrayed in geometric rows effective to allow unimpeded access therethrough of wheelchair devices and the like; a bottom surface comprised of a plurality of transverse and longitudinal or crisscrossing members integral with the opposite side of the human-contacting top surface, optionally integral with each other; and further optionally comprising one or more anchor means integral with one or more portions of the bottom surface, such as transverse, longitudinal or crisscrossing member portions, for facilitating the detachable installation of the tiles onto pedestrian use material, such as concrete and the like.

In other aspects of the invention the inventive pedestrian-use tile may be provided in a variety of geometric shapes, such as substantiality planar top surfaces with angled, rectangular, trapezoidal, hexagonal, octagonal and triangular shapes effective to fit together in a plurality of their usage and juxtaposed with each tile unit in a flush-fitting manner effective to form a continuous unbroken surface covering which mimics in a flush-fitting manner the walking surface topography of a selected or desired pedestrian-use surface, such as a sidewalk portion facing a street or body of water, a portion of a subway platform, or a sloping sidewalk portion intended for wheel chair use and the like.

In further preferred aspects of the present invention, the inventive pedestrian-use tiles as detachably installed are substantially less prone to fracture and breakage under usage and in collisions with snow removal equipment and other machinery, and are easily replaceable as desired or as necessitated.

In still further aspects of the invention, there are provided an array of business functions, heretofore unavailable, which comprise the design, manufacture, use, marketing, sale and other business activities involving the inventive tile products.

These and other features, aspects and advantages of the present invention will become better understood with reference to the following Detailed Discussion of Preferred Embodiments with accompanying drawings, examples and claims.

DETAILED DISCUSSION OF PREFERRED EMBODIMENTS

Figure 1B:
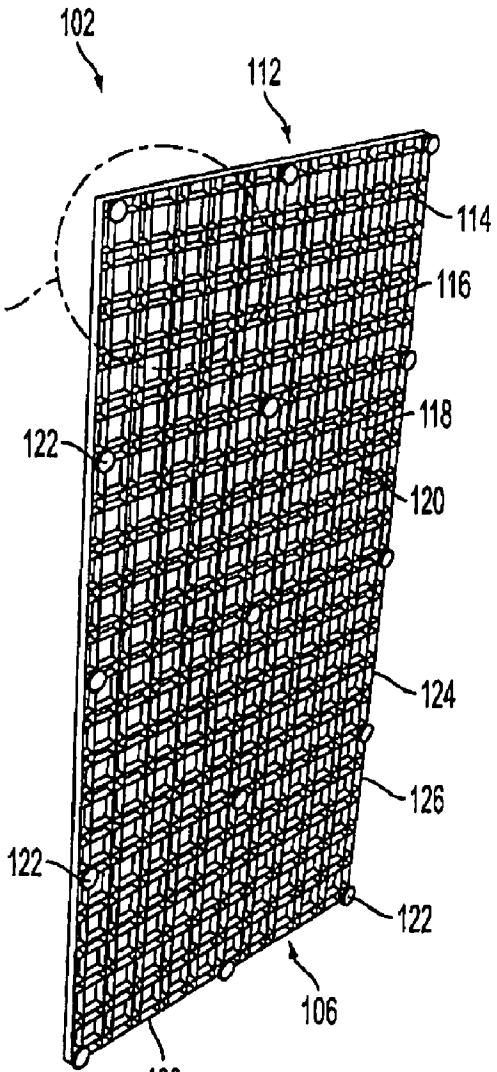
FIGS. 1*a* and 1*b* illustrate in respective perspective views the top surface and undersides of a preferred embodiment of a tactile tile or panel having parallel side and end portions in accordance with the invention.

All patent references, published patent applications and literature references referred to or cited herein are expressly incorporated by reference to the same extent as if each were specifically and individually indicated to be incorporated by reference. Any inconsistency between these publications and the present disclosure is intended to and shall be resolved in favor of the present disclosure.

Having prefaced this discussion, the present inventive products and methods are primarily designed for use as detectable warning surfaces for pedestrians and other individuals, and especially for alerting visually impaired individuals to potential hazards, such as curb drop-offs, street crossings, boarders of pools, boating areas and marinas, oncoming traffic, railroad crossings, drop-offs from raised platforms and the like. The inventive products and methods are also preferably designed to comply with prevailing American with Disabilities Act ("ADA") rules and regulations, and those of state and local municipalities, dealing with accessibility on walkways in public rights of way and requirements, or desires, with respect to surfaces of walkways and other public (and private) pedestrian-used walking surfaces that enable tactile detection by visually impaired persons.

As well known, conventional products and methods for complying with ADA rules and regulations of the ability to detect one's presence in a potentially dangerous local is to provide walking surface panels which have tactilely detectable warnings oftentimes composed of surface patterns of raised dome structures which can be detected, for example, by a cane or walking stick or a foot to alert people with vision impairments. See the ADA Accessibility Guidelines (ADAAG). In this respect tactile materials, commonly made in the form of tiles or panels which comprise a plurality of raised tactile domes, are usually manufactured to be permanently embedded in fresh concrete or asphalt or surface mounted thereto in essentially permanent fashion at strategic areas, such as at an approach to an existing crosswalk. When installed, many of these panels or tiles enclose an air gap or pocket beneath the underside walking surface of the panels, and particularly beneath the underside of the tactile dome structures, and which is also enclosed by the surface of the material in which the panel is embedded. This air gap or pocket becomes a resonating device when struck or tapped with an object, such as a cane or stick or even one's foot or shoe, which produces an audible sound an also produces a surface for feel or touch, with sound and feel oftentimes recognizable due to standardization.

Many tactile tiles and panels and other products are made from fiber-reinforced product ("FRP") composites by either compression molding or hand-lay up and pressed to shape. Some are formed as inverted square or rectangular pan with ribs parallel to two opposing sides. The top of the tile may have a series of truncated domes or other protrusions along with a plurality of smaller domes or protrusions which may act as traction or anti-slip surfaces. The undersides of many of such tiles or panels also have flanges around the perimeter and through the center areas parallel to the two sides. Further, the bottom or undersides of such tiles or panels may have downward protruding domes or structures which are thought to maintain contact with surface areas of material in which they are embedded through an air gap or pocket to maintain structural support and to prevent fracture of the tile or panel when subjected to high weight and/or pressure loads, such as heavy machinery. As discussed, conventional permanently installed tiles which become fractured must be replaced by physically removing embedding material, e.g. concrete, with new tile permanently installed in embedding material. Such breaking or digging out fractured tile necessarily entails high expense and labor costs, as such tiles frequently do fracture and become ineffective and/or dangerous.

In accordance with the present invention there is provided in its broadest sense an improved stronger and longer lasting design of a tactile tile for use by pedestrians, especially the visually impaired, which is made with a plurality of tactile domes comprising a top pedestrian contacting surface and an underside surface comprising a honeycombed structure, and preferably further comprising in one preferred aspect chiseled or cone-shaped underside portions, some of which may be anchor means, which are in contact with material in which such inventive tile is detachably installed for use. More particularly, the present invention provides pre-cast textured tactile tiles effective for substantially flush installation in a pedestrian-use surface, and which tiles comprise a substantially planar top surface for human contact, with the surface itself comprising a plurality of raised surface elements projecting upward for human contact and sound emitting purposes when struck, and preferably arrayed in geometric rows effective to allow unimpeded access therethrough by wheeled devices, such as wheelchairs. The inventive tactile tiles further comprise a bottom surface opposite the top surface comprised of a plurality of substantially transverse and substantially longitudinal or crisscrossing members integral with the opposite side of the human-contacting top surface or bottom surface, optionally integral with each other, and further optionally comprising one or more anchor means integral with one or more portions of the bottom surface, such as transverse, longitudinal or crisscrossing member portions, effective for the enhanced detachable installation (and removal) of the tiles in pedestrian-use material, such as concrete, asphalt and composite materials and the like, or even in wood surfaces which have been sculptured to receive the inventive tiles in a flush fitting walking surface relationship Turning now to FIGS. 1*a* and 1*b*, there is shown in respective perspective views the top surface (108), 1 *a*, and underside or bottom surface (112), 1 *b*, of a preferred embodiment of a tactile tile or panel (102) in accordance with the present invention, and which is illustrated with parallel side (104) and end (106) portions. A typical tile or panel may be of proportions of whatever is standard in the industry, such 24"×48", and W in thickness, as shown by parallel side (104) and end (106) portions in this illustration. The top surface area (108) designed for human contact, or otherwise pedestrian usage, is provided with a plurality of tactile domes (110) effective for sound-emitting purposes when struck, for instance, with a cane or stick, or a person's shoe, or really anything, when the tile is detachably installed in a pedestrian-use area or walkway and entraps a quantity of air. The size of the domes (110) is not critical to the practice of this invention, but are preferably of standard size or size range as used with any of the conventionally available pedestrian-use tactile tiles or panels. Additionally, the tactile domes (110) are preferably arranged in a geometric array on the surface (106) of the tile, or in any way-finder pattern, such that access therethrough by wheeled devices, such as a wheel chair or cart and the like is not impeded or obstructed. Also, the projections or domes may me be altered as desired in size, form, distribution pattern and spacing to meet any requirement.

Figure 1A:
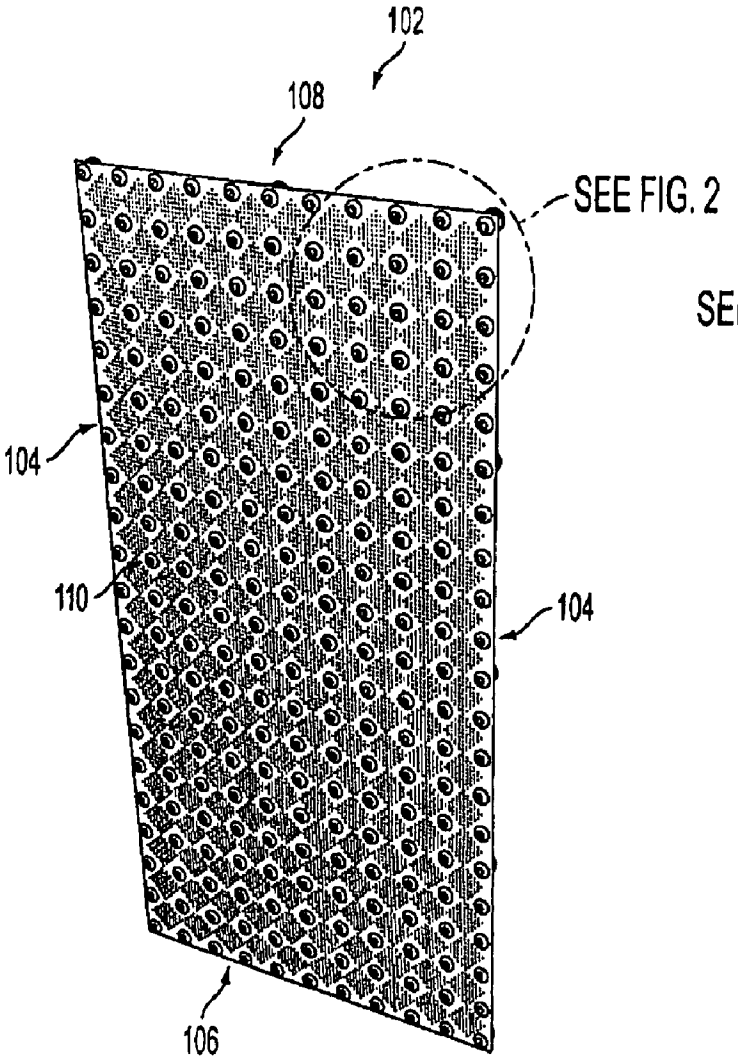

Referring to FIG. 1*b*, as shown by the underside or bottom surface (112) of the tile (102), opposite the top surface area (108), there are provided a plurality of substantially transverse structural members (114) and substantially longitudinal structural members (116), or otherwise crisscrossing structural members, herein arranged in this embodiment in a honeycombed configuration, shown generally as (118), and which are integral with the bottom surface (112) of the tile (102). The honeycomb configuration is preferred in some applications or installations, as it reduces weight, increases the strength, aids in load weight distribution and enhances the rigidity of the tactile panel, all of which greatly reduce cracks and breakage of tiles. Typically, open spaces (120) in the honeycomb configuration may be of the most effective strength and rigidity enhancing size, as determined for a particular application, with a typical example being about ⅜" in diameter and about ⅜" deep for the size of tactile tile described above. They may be spaced in rows and columns with a center-to-center distance of, for instance, approximately 7/'16" for the illustrated size of the tile in this embodiment, and may contain larger open spaces adjacent to smaller open spaces, as shown in FIG. 1*b*. While the honeycomb configuration may be preferred for structural members (114) an (116), a wide variety of other geometric configurations of any dimensions, such as rectangular crosshatch of varying dimensions, or any of pentagonal, hexagonal, or octagonal configurations and the like of structured members (114) and (116) integral with bottom surface (112) are also contemplated for use in this invention depending upon the end use(s) contemplated and/or particular application(s) in mind. In other applications, as discussed below, the honeycomb configuration is also advantageous for trapping air in the thus formed cells or spaces (120) between the bottom surface (112) of the tactile tile and, say, a concrete surface on which a panel is detachably installed, and effective for the creation of sound-emitting tactile domes (110).

Figure 2:
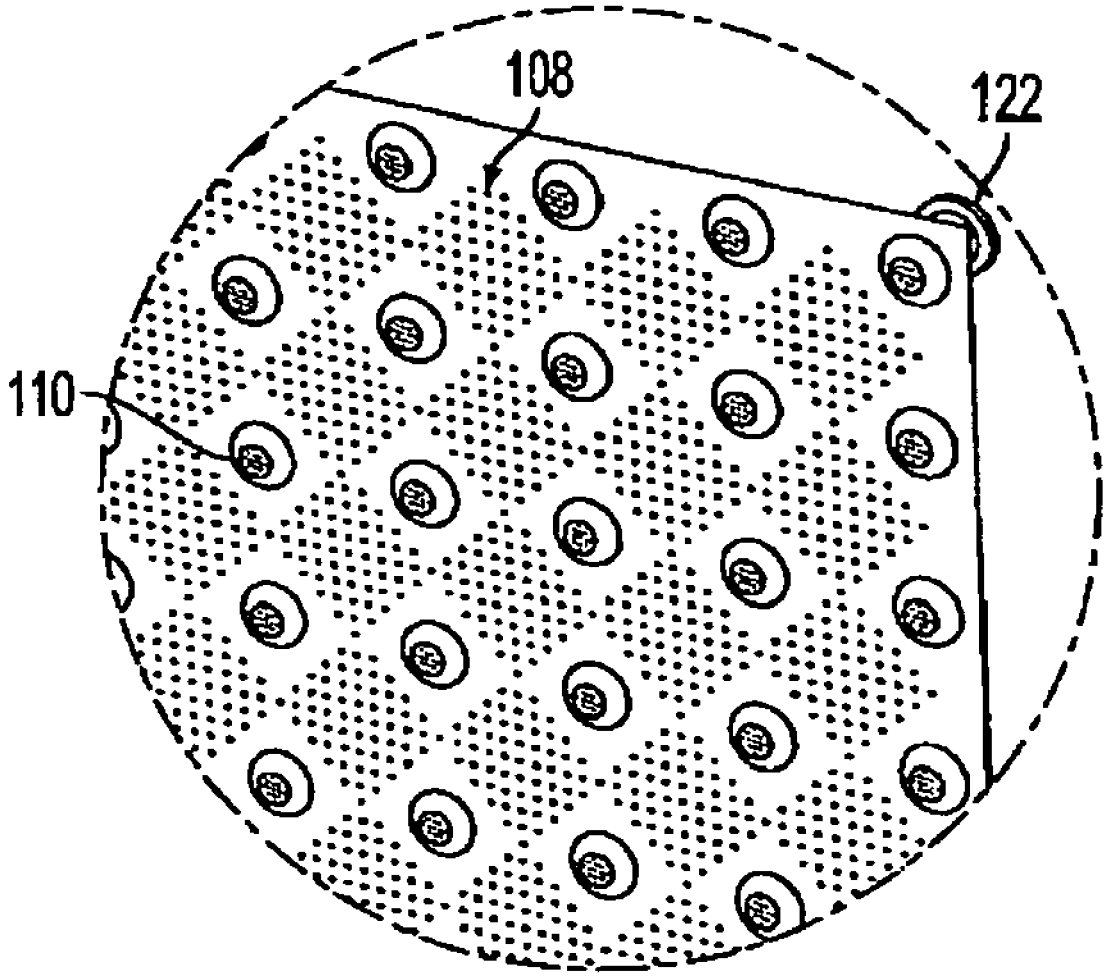
FIG. 2 illustrates in perspective cut-away exploded view of preferred features of the periphery of the top portion of the tactile tile viewed in FIG. 3.
Figure 3:
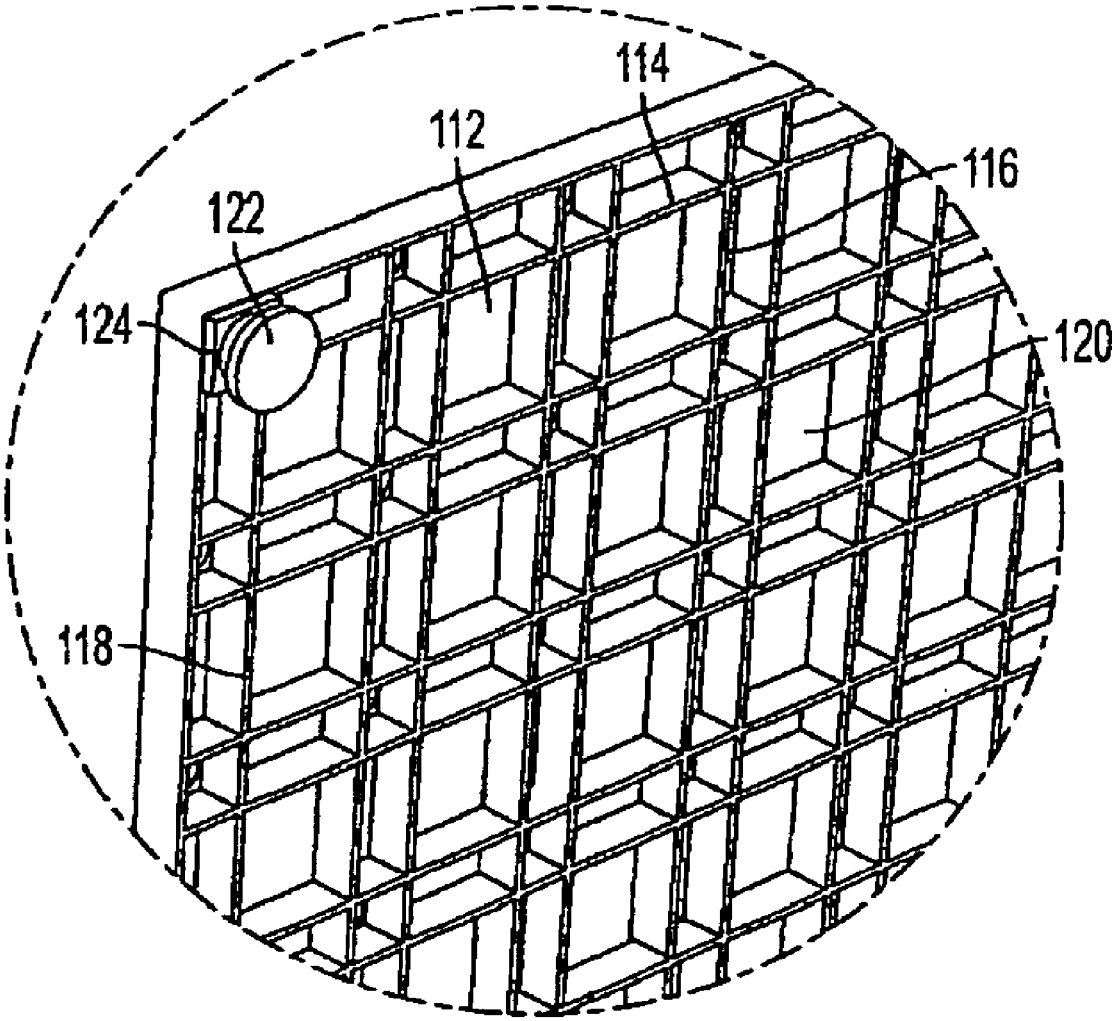
FIG. 3 illustrates in perspective cut-away exploded view of preferred features of undersides or bottom portions of the tactile tile viewed in FIG. 3.

As further illustrated in FIGS. 2 and 3, respectively, the partial cut-away perspective view of top and undersides are shown as preferably equipped with one or more anchor means, or lugs (122) integral with one or more portions of the bottom surface (112), such as portions of the periphery (124) of the bottom portions (126) of parallel side (104) and/or end (106) portions, and/or portions of the bottom portions (128) of the structural members (114) and (116). These lugs (122) are found to provide a convenient and effective means and method for solidly and non-movably detachably installing a tactile tile or panel of the invention in a substantially flush-fitting relationship with a pedestrian-use surface, such as placed onto a concrete, earth, composite material or wood surface as the case may be. The substantially bottom portions of the anchors or lugs (122) opposite portions integral with the tile bottom surface (112) will be the portion substantially permanently embedded in a pedestrian-use surface, such as more or less permanently embedded in a non-moveable fashion in concrete, asphalt or dirt and the like, with their top portions integral or detachably connected to the undersides portions of a panel. This arrangement preferably forms an air space, or plurality of air spaces, in the preferred embodiments of this invention employing a honey-combed undersides configuration or other geometrical configuration with transverse and longitudinal member bottom portions also touching or installed onto the pedestrian use surface. The air spaces thus formed by a tile installation will be responsible, at least in part, for a hollow or other distinctive sound being generated when an installed tile surface is rapped and struck, for example, with a blind person's cane, to create an audible warning signal for a person having impaired vision to determine their position in relation, say, to a cross-walk or subway platform edge and the like, and to be made aware of potential dangers.

Figure 4:
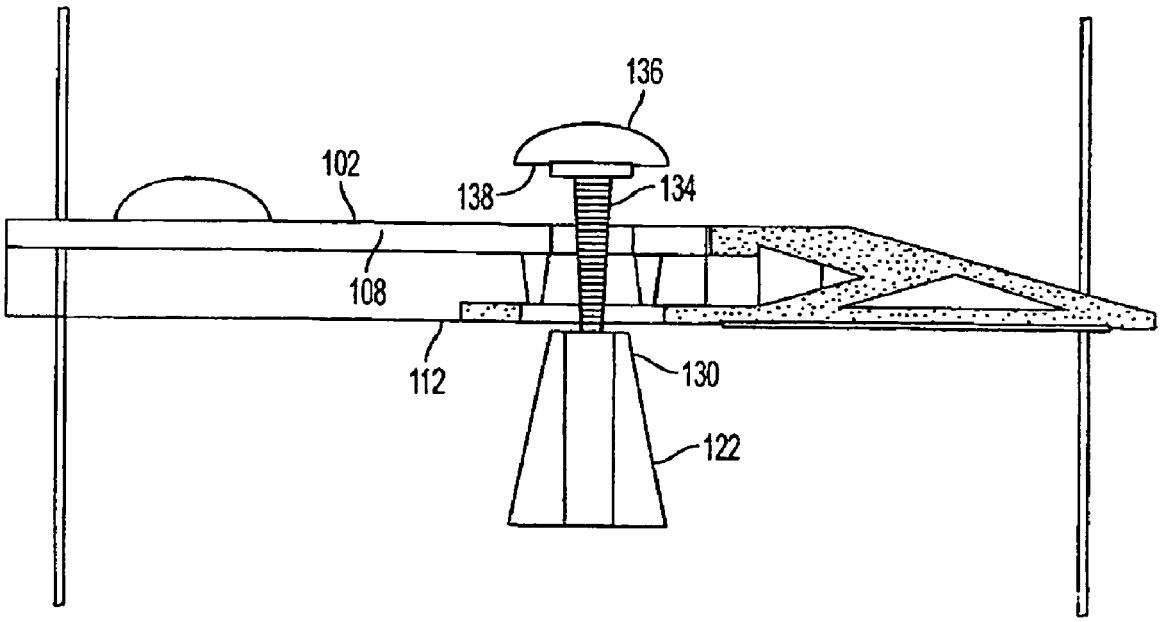
FIG. 4 illustrates a preferred feature embodiment of the inventive tactile tiles.
Figure 5A:
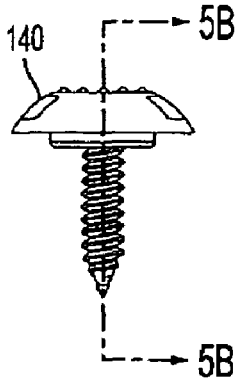
FIG. 5 illustrates a perspective elevational view of another preferred feature embodiment of the inventive tactile tiles.
Figure 5B:
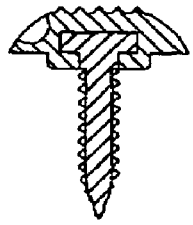
Figure 5C:
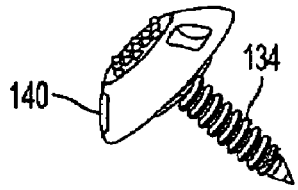
Figure 5D:
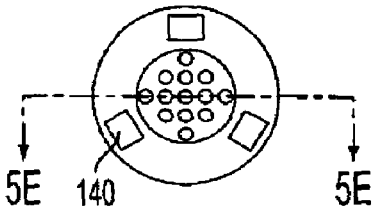
Figure 5E:
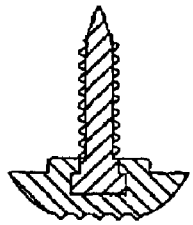
Figure 5F:
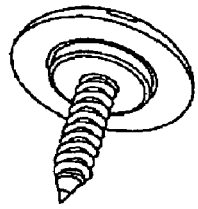
Figure 6A:
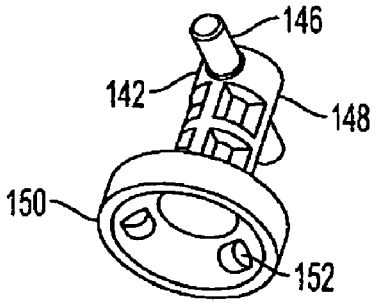
FIG. 6 illustrates in perspective elevational view of another preferred feature embodiment for use with the inventive tactile tiles.
Figure 6B:
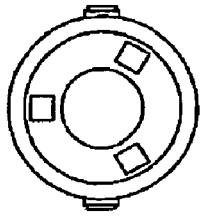
Figure 6C:
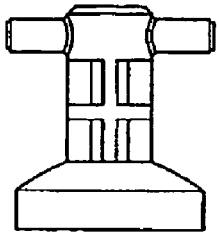
Figure 6D:
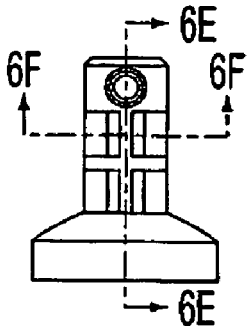
Figure 6E:
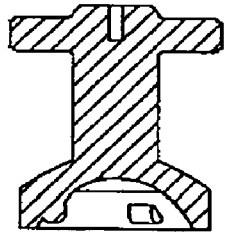
Figure 6F:
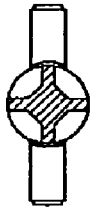
Figure 6G:
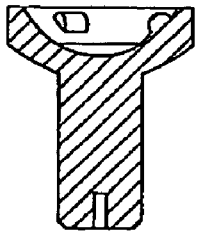
Figure 6H:
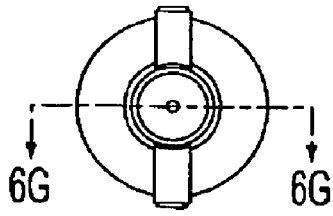

In a preferred embodiment as shown in FIG. 4, the lugs (122) may be cone-shaped or frusto-conical in shape and preferably hollow in portions to aid in curtailing deformation or warping during or after casting or fabrication. Any and all other shapes of lugs (122) are contemplated for use in this invention, such as inverted pyramidal shapes, sphere or rectangular shapes, circular or spherical shapes, cylindrical and tubular shapes and the like, or various combinations thereof. In this preferred embodiment lugs (122) are shown with their slimmest portion (130) integral with portions of the bottom surface (112). In this illustration of a preferred embodiment of a panel sized as described above, the top or slimmest portions (130) of a lugs (122) where they are integral with the bottom surface (112) of the tile (102) may be approximately 1" in diameter with each cone shaped lug (122) approximately 1" or more in length (132) as extending perpendicular downward from the bottom surface (112). However, the size of the lugs (122) employed is not critical to the practice of this invention, as long as they are effective to detachably and immovably secure in place a tile in accordance with the invention. In some preferred applications, such as when embedded in concrete, the frusto-conical shaped configuration is found to prevent the lug from being easily pulled out from its concrete bed or other permanent embedment.

There may be as many lugs (122) as desired or found effective for a particular application, but in general a lug (122) situated, for instance, at each corner of a rectangular-shape tactile panel (102) is probably sufficient for most purposes to solidly detachably anchor a panel (102) in a non-movable, flush-fitting relationship with a pedestrian-use surface for purposes of this invention. In some other preferred embodiments, for example, with a tile of, say 2'×4' width and length dimensions, there may be a plurality of anchors or lugs present, such as at each corner of the tile and also equally dispersed width and lengthwise. In some detachable installations, the employ of fifteen anchors in such a pattern has been preferred. Simple research and development without undue experimentation will provide the requisite information as to the number of lugs (122) and their spacing and placement for a particular application.

In still further preferred aspects and embodiments as shown in FIG. 4, the lugs (122) may be conveniently detachably fastened to portions of the bottom surface (112) of the tactile tiles (102) by way of any conventional (or unconventional) fastening means, such as a screw means (134), and preferably employing rust-proof fasteners and the like. This preferred embodiment has unexpectedly been found to facilitate the detachable installation and easy removal of damaged tile as needed without chipping out or tediously and laboriously removing embedding material. In accordance with this preferred aspect of the invention a tactile panel may be removed from a pedestrian-use area for replacement by way of simple hand tools without the need for concrete replacement.

As also shown in FIG. 4, fastening or screw means 134 is inserted or screwed through a tile (102) portion and thereafter into a portion of lug or anchor means (122) to detachably fasten the tile (102) to the anchor (122). In this preferred embodiment, a top portion (136) of the fastening means (134) is provided in the shape of a tactile dome (110) which undersides thereof (138) will sit in a flush-fitting arrangement with the top portion or surface area (108) of tile (120) when the fastening means (134) is installed through the tile (102) and into the anchor means (122).

The fastening means (134) are also contemplated to detachably connect to one or more anchor means (122) in a substantially unmovable manner anywhere as desired through the tile surface (102), and wherein the top portion (136) thereof may or may not form the shape of a tactile dome (110). For instance, screwed in fastening means with tops flush fitting with the top surface (108) of tile (102), and detachably connected to one or more anchor means (122) may be dispersed in any pattern between tactile domes (110). They may be inserted and removed in any conventional manner, such as by the use of a flat or Phillips head screwdriver head, or by a hex key arrangement and the like.

As shown in FIG. 5 in another preferred embodiment of the invention, the fastening means (134) may be formed with its top portion (136) in the shape of a tactile dome (110), which includes one or more slots (140), such as three shown in this embodiment, into which a tool may be inserted or placed to install and remove the fastening means (134), for example, when removing a damaged tile portion from permanently embedded anchor means (122).

In still yet another preferred embodiment, in some instances, a special tool (142) may be provided, as shown in FIG. 6, to install and remove the preferred embodiment of fastening means (134) shown in FIG. 5. Here tool (142) comprises a grippable portion (146), such as one may form a handgrip on or fasten a tool about, such as pliers and the like, for turning the tool in clockwise or counterclockwise directions relative to the tile surface (102), a body portion (148), with an bottom end (150) opposite the grippable end portion (146), which comprises a number of integral abutments (152) which may be mated with and inserted into the slots (140) situated in the tactile dome-shaped portion (136) of fastening means (134), and which will then frictionally engage the head portion (136) for turning clockwise and counterclockwise, as the case may be, for installation and removal of the fastening means (122). As also shown, the abutments (190) are preferably enclosed by a skirt portion (154) integral with the bottom portion (150) of tool (142) which may be internally diameter sized to fit neatly around dome-shaped end portion (136) for a more secure turning grip or arrangement.

Figure 7:
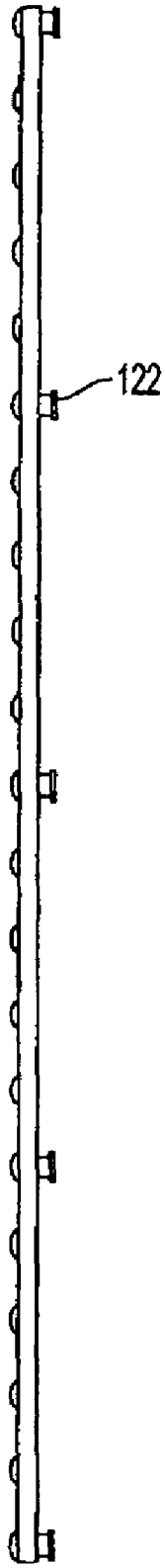
FIGS. 7 and 8 illustrate plan views of parallel side and end portions, respectively, of the preferred embodiment of tactile tile of FIG. 1.
Figure 8:
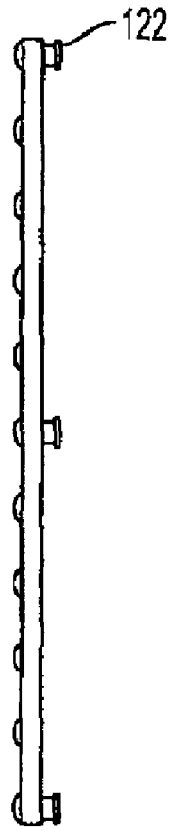

As shown in FIGS. 7 and 8, respectively, a configuration of anchor means (122) are attached to side and end portions of a tile in accordance with the invention.

Initially, in a preferred mode of installation, the tactile panel (102) with lugs (122) attached may be set into an uncured concrete bed and leveled to be in a substantially flush-fitting arrangement with a surface pedestrian-use area, such as by tapping and/or vibrating with a mallet. When properly set, the tactile tile (102) bottom surface (112) will also preferably be in contact with a surface into which it is embedded, including the bottom portions or surfaces (128) of structural members (114) and (116) thereby entrapping air between structural members (114) and (116), the bottom surface (112) of tile (102) and the embedment surface and effective for purposes of the sound-emitting dome structures (110) to provide a rigid and break-resistant, but yet easily removable and installable by way of detachable anchor means (122), superior tactile tile or panel. The tile will also be properly and immovably set in a juxtaposed position to a plurality of neighboring tiles to form a flush-fitting and continuous tactile surface.

In still yet another preferred embodiment of the invention, the bottom surfaces (128) of the structural members (114) and (116) and/or those of the periphery (124) of the bottoms of parallel sides (104) and end portions (106) may be provided in a chiseled or V-shape configuration (138) for still further effectively enhanced immovable embedded placement in a pedestrian-use area.

In yet still another preferred aspect of the invention, the tactile tile (102) may be installed with lugs (122) intact into an embedment surface (134), but with a material covering the bottom surface (112), except for the protruding lugs (122). In this embodiment, a minimum of entrapped air, or substantially only that needed for effective sound-emitting dome structures will be present while installing an inventive tactile tile or panel, and reducing or avoiding an excessive amount of entrapped air which may facilitate cracking or fracturing of tiles.

In still further embodiments the tactile tiles of the present invention may be provided in a variety of geometric shapes, such as in triangular, trapezoidal, pentagonal, hexagonal, or octagonal shapes and the like, and to fit in a juxtaposed manner together in a flush-fitting arrangement with substantially any geometrically shaped pedestrian-use area to form a continuous surface with protruding sound-emitting dome structures, whether on a substantially flat surface or a partially sloping surface such as a wheelchair ramps.

The tiles or panels of the invention may be fabricated from any suitable material, or different portions made from a variety of materials, including, but not limited to, steel, stainless steel, galvanized steel, hard plastics, impact resistant plastics and composites, fiber reinforced plastics, resins and the like, or even wood products with, for instance, plastic tactile domes, or any future developed materials and composites found suitable for such uses, which at the present time may be unforeseeable, but yet contemplated for use herein just the same. Some preferred examples include glass reinforced epoxy, glass reinforced polyester, either with or without inorganic particulate matter, such as sand or ceramic dust, or a mixture of polyurethane and inorganic particulate matter, such as ceramic dust. Additionally, the inventive tiles may be made by any conventional (or non-conventional) manufacturing process, such as by injection molding, hand lay-up etc., any of which are well with the knowledge and skill of persons skilled in the art.

As will be further appreciated by those persons skilled in the art, the present inventive products, method of manufacture and use afford distinct business advantages not previously available to vendors and other business-minded entities. In this aspect, the present invention provides novel methods of conducting a wide array of traditional business functions comprising, inter alia, designing, manufacturing, using, marketing, selling, licensing, and/or leasing the inventive subject matter, of developing business good will with the use thereof, of developing valuable trade mark rights in conjunction with the use thereof, and further in providing subject matter for novel methods of business entity formation, such as partnerships, corporations, joint ventures, and other collaborations for the purpose of exploiting the business of the inventive subject matter.

While this invention has been described in connection with what is presently considered to be the most practical and preferred embodiments, it is to be understood that the invention is not to be limited to the disclosed embodiments in any way, as such are merely set forth for illustrative purposes only, The present inventive products, methods of manufacture and use, and methods for conducting business therewith are intended to cover an array of various modifications and equivalent arrangements, all of which are contemplated for inclusion within the scope and spirit of the disclosure and appended claims.

I claim:

1. Tactile tile comprising substantially hemispherical-shaped outward protruding domes on an upper surface for pedestrian traffic, said domes being effective for sound permitting purposes when struck, and a plurality of a substantially rigid longitudinal and transverse members integral with each other and integral with a bottom side of the tile opposite the upper surface, and forming a substantially rigid pattern on the bottom side.

2. The tile of claim 1 further comprising of a plurality of detachable anchor means integral with the bottom side of the tile.

3. The tile of claim 2 wherein one or more of said detachable anchor means comprises a protruding dome on said upper surface of said tile, and an opposite bottom end effective for permanently embedding into pedestrian surface traffic material, and whereby said protruding dome of said anchor means may be detached from said anchor and to remove the tile from installation, and to replace with another tile upper surface by attaching same to said anchor means.

4. The tile of claim 1 as fabricated from materials selected from steel, hard plastics, impact resistant plastics and composites, fiber reinforced plastics, wood, glass, reinforced epoxy, glass reinforced polyester, a mixture of glass reinforced polyester with inorganic particulate matter, and a mixture of polyurethane and inorganic particulate matter.

5. The tile of claim 2 as fabricated from materials selected from steel, hard plastics, impact resistance plastics and composites, fiber reinforced plastics, wood glass, reinforced epoxy, glass reinforced polyester, a mixture of glass reinforced polyester with inorganic particulate matter, and a mixture of polyurethane and inorganic particulate matter.

6. The tile of claim 3 as fabricated from materials selected from steel, hard plastics, impact resistance plastics and composites, fiber reinforced plastics, wood glass, reinforced epoxy, glass reinforced polyester, a mixture of glass reinforced polyester with inorganic particulate matter, and a mixture of polyurethane and inorganic particulate matter.

7. A method for the production of the tile of claim 1 selected from hand made, hand lay-up, molding, pressing, injection molding from materials selected from steel, stainless steel, galvanized steel, plastic, composites, fiber reinforced plastic, fiber reinforced composite, wood composites, glass reinforced epoxy, and glass reinforced polyester.

8. A method for the production of the tile of claim 2 selected from hand made, hand lay-up, molding, pressing, injection molding from materials selected from steel, stainless steel, galvanized steel, plastic, composites, fiber reinforced plastic, fiber reinforced composite, wood composites, glass reinforced epoxy, and glass reinforced polyester.

9. A method for the production of the tile of claim 3 selected from hand made, band lay-up, molding, pressing, injection molding from materials selected from steel, stainless steel, galvanized steel, plastic, composites, fiber reinforced plastic, fiber reinforced composite, wood composites, glass reinforced epoxy, and glass reinforced polyester.

10. A method for the production of the tile of claim 4 selected from hand made, band lay-up, molding, pressing, injection molding from materials selected from steel, stainless steel, galvanized steel, plastic, composites, fiber reinforced plastic, fiber reinforced composite, wood composites, glass reinforced epoxy, and glass reinforced polyester.

11. A method for the production of the tile of claim 5 selected from hand made, hand lay-up, molding, pressing, injection molding from materials selected from steel, stainless steel, galvanized steel, plastic, composites, fiber reinforced plastic, fiber reinforced composite, wood composites, glass reinforced epoxy, and glass reinforced polyester.

12. A method for the production of the tile of claim 6 selected from hand made, hand lay-up, molding, pressing, injection molding from materials selected from steel, stainless steel, galvanized steel, plastic, composites, fiber reinforced plastic, fiber reinforced composite, wood composites, glass reinforced epoxy, and glass reinforced polyester.

13. A method for installation and removal of the tile of claim 1 comprising fastening or unfastening an attachment means comprising a portion of a dome means.

14. A method for installation and removal of the tile of claim 2 comprising fastening or unfastening an attachment means comprising a portion of a dome means.

15. A method for installation and removal of the tile of claim 3 comprising fastening or unfastening an attachment means comprising a portion of a dome means.

16. A method for installation and removal of the tile of claim 4 comprising fastening or unfastening an attachment means comprising a portion of a dome means.

17. A method for installation and removal of the tile of claim 5 comprising fastening or unfastening an attachment means comprising a portion of a dome means.

18. A method for installation and removal of the tile of claim 6 comprising fastening or unfastening an attachment means comprising a portion of a dome means.

19. A tool means for installation and removal of the tile of claim 3.

* * * * *